United States Patent [19]

Suzuki et al.

[11] 4,354,533

[45] Oct. 19, 1982

[54] AUXILIARY NOZZLE FOR JET LOOMS

[75] Inventors: Hajime Suzuki, Anjo; Hiroshi Arakawa, Kariya, both of Japan

[73] Assignee: Kabushiki Toyoda Jidoshokki Seisakusho, Kariya, Japan

[21] Appl. No.: 154,119

[22] Filed: May 28, 1980

[30] Foreign Application Priority Data

May 31, 1979 [JP] Japan ..... 54-72531[U]

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,978,896 9/1976 Larmit ..... 139/435

FOREIGN PATENT DOCUMENTS 2740108 3/1978 Fed. Rep. of Germany ..... 139/435

2022630 12/1979 United Kingdom ..... 139/435

*Primary Examiner*—Henry Jaudon

*Attorney, Agent, or Firm*—Brooks, Haidt, Haffner & Delahunty

[57] ABSTRACT

An apparatus for assisting a weft picked into a shed by main nozzle of a jet loom in being inserted through the shed properly is provided. The apparatus comprises improved auxiliary nozzles, each of which has formed therein a first outlet opening for discharging weft pick assisting jets of fluid therethrough and a second outlet opening for discharging weft pick stabilizing jets of fluid therethrough, said first and second outlet openings being arranged in spaced relation to each other along the axis of said auxiliary nozzle and also in such a way that the axes of said first and second outlet openings will form an angle thus directing in different direction from each other so that harmful turbulence of fluid due to interference thereof may be prevented successfully from taking place.

16 Claims, 9 Drawing Figures

AUXILIARY NOZZLE FOR JET LOOMS

BACKGROUND OF THE INVENTION

The present invention relates to an apparatus for assisting a weft, picked up into a shed of any jet loom by the jetting action of compressed fluid discharged from the main nozzle into the weft picking channel, in being picked through said shed completely by means of novel auxiliary nozzles which are adapted to issue auxiliary jets of fluid into the picking channel of said loom. It relates, more specifically, to the provision of an auxiliary nozzle which has jetting apertures or outlets for weft-flight assisting and stabilizing, respectively, formed therein so that the weft being picked through the shed may be corrected properly by the streams of fluid jetted from such outlets of said auxiliary nozzle.

Auxiliary nozzles in fluid-jetting type looms call for fulfillment of two different functions; namely, (A) to assist or aid the weft in being inserted through the shed, and (B) to stabilize the weft being thus inserted through said shed. In order that the first requirement (A) is met successfully, the fluid should be discharged from the auxiliary nozzles in such a way that the fluid impinges against the weft with preferably as small angle as possible with respect to the direction of weft movement; whereas, to fulfill the second requirement (B) properly, the fluid should act on the weft being picked preferably perpendicularly thereto as much as possible. In actual picking operation in connection with the second functional requirement (B), however, there is a tendency that jetting auxiliary fluid more perpendicular to the weft will make it easier for such fluid to escape through the gaps formed between the weft guiding members, thereby allowing the weft to be entrained by such escaping fluid with a result that the weft as well would escape out of the weft picking channel formed by the guiding members.

Auxiliary nozzles heretofore, which have attempted to fulfill the aforesaid two requirements (A) and (B) by means of fluid jetted from a single outlet, pose difficulty in proper selection of effective angle and velocity at which the fluid is jetted from the auxiliary nozzles. In other words, it is required that the weft should be pushed preferably deeper into the opening of the weft guiding members for meeting the functional requirement (B), but by so doing the requirement (A) tends to become in turn more difficult to be accomplished, whereby very careful consideration must be provided to the setting of fluid jetting velocity.

To cite for your reference for better understanding of the present invention, our U.S. patent application Ser. No. 15,486 (filed on Feb. 26, 1979) is an invention which places more emphasis on fulfillment of the above-described functional requirement (B).

SUMMARY OF THE INVENTION

The present invention features provision of separate, independant fluid-jetting outlets in an auxiliary nozzle for further improving the weft-flight assisting and stabilizing functions, respectively, of auxiliary jets of fluid. To compare it with conventional auxiliary nozzles more specifically, while the auxiliary nozzles heretofore have used a single jetting outlet which requires hard and careful setting of angular direction thereof with respect to the weft picking passage in an attempt to meet the aforementioned two requirements (A) and (B) simultaneously, the auxiliary nozzle according to the present invention, on the other hand, is so provided as to have a plurality of jetting outlets, each of or each group of said outlets being adapted to perform their respective exclusive functions so that optimum fluid velocities necessary for fulfillment of the two requirements (A) and (B) may be obtained at a time. In addition, the jetting outlets for respective different functions are positioned in such a way that they are spaced from each other in axial direction of the auxiliary nozzle and also that they are facing in different ways with an angle, so that irregular turbulence of fluid due to interference of such fluid discharged from separate outlets may be avoided.

Thus, the respective fluid outlets can be so arranged as to make it possible to determine the directing angles and jetting velocities which are best suited for fullfillment of the respective requirements. It will be understood by those who are skilled in the art that jet velocity changing can be accomplished, preferably, by changing the diameter of size of dimensions of the outlets of the auxiliary nozzle.

DETAILED DESCRIPTION OF THE PREFERRED EMBODIMENT

Figure 1:
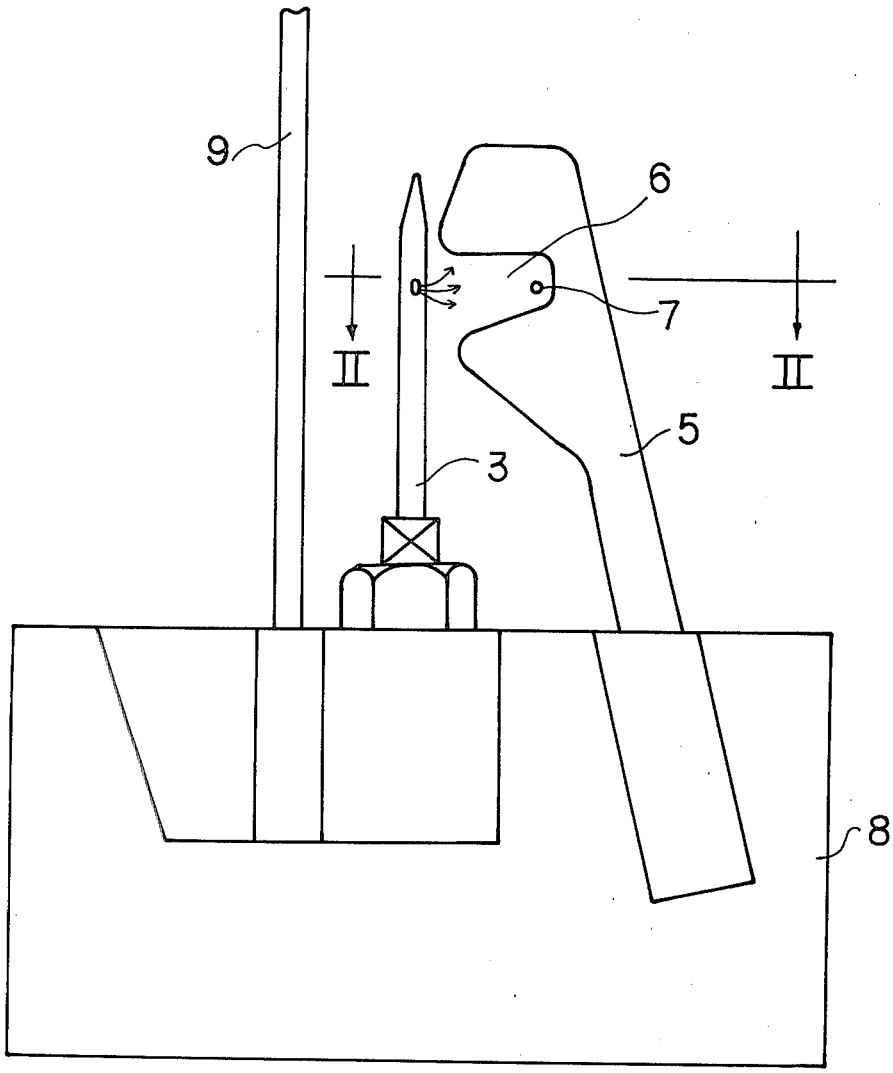
FIG. 1 PRIOR ART
FIG. 1 is a side elevation of a conventional apparatus.
Figure 2:
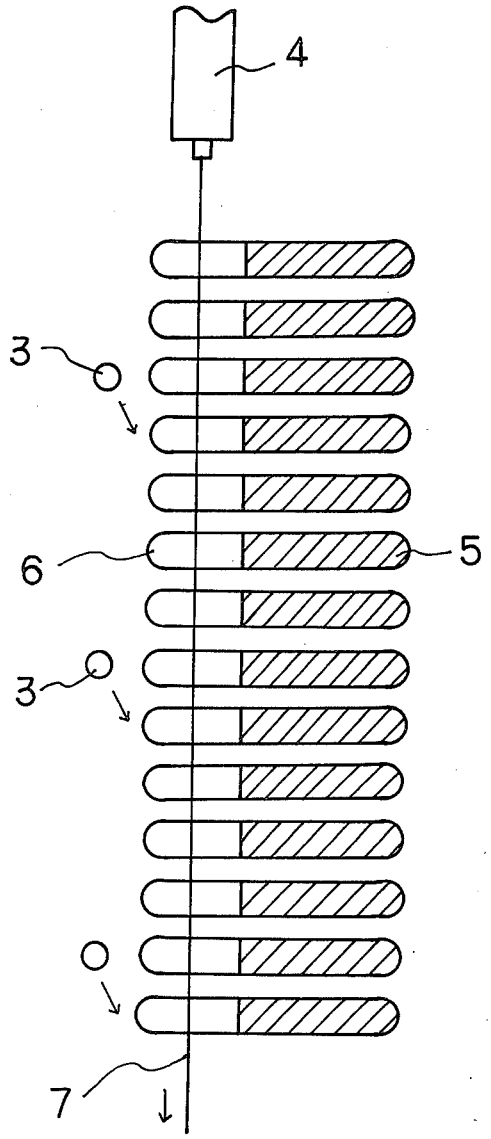
FIG. 2 PRIOR ART
FIG. 2 is a sectional plan view as seen from line II—II of FIG. 1, showing major component parts thereof.

The following will provide detailed description of a preferred embodiment of the present invention with reference to the accompanying drawings:

Referring to FIGS. 1 and 2, a conventional apparatus is shown, wherein a weft thread 7 is blown in the filling direction by a jet of fluid discharged from a main nozzle 4 of said apparatus into the weft picking channel 6 formed by the guide members 5 mounted on the race slay 8 which also carries a reed 9 thereon, and said weft 7 is then assisted by auxiliary jets of fluid discharged from the auxiliary nozzles 3 in being picked through said channel.

Figure 3:
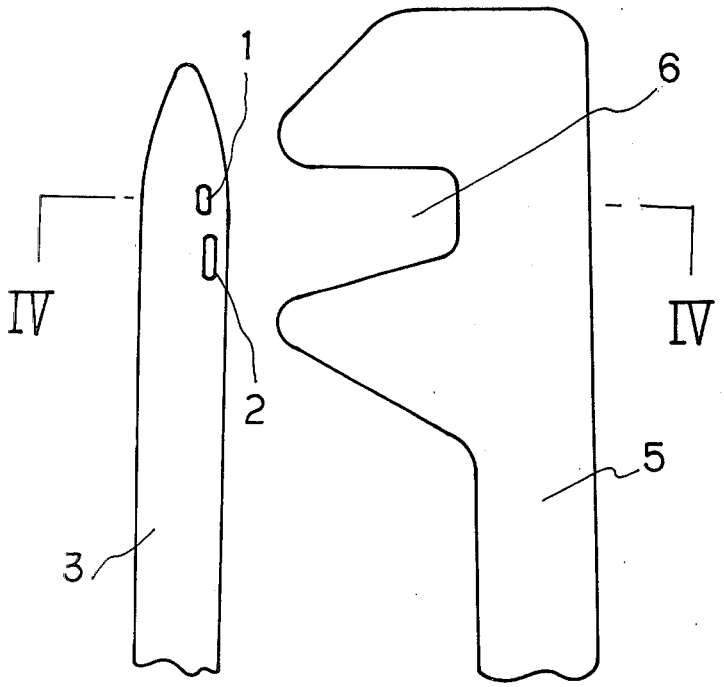
FIG. 3 is a side elevation of an apparatus embodied according to the present invention.
Figure 4:
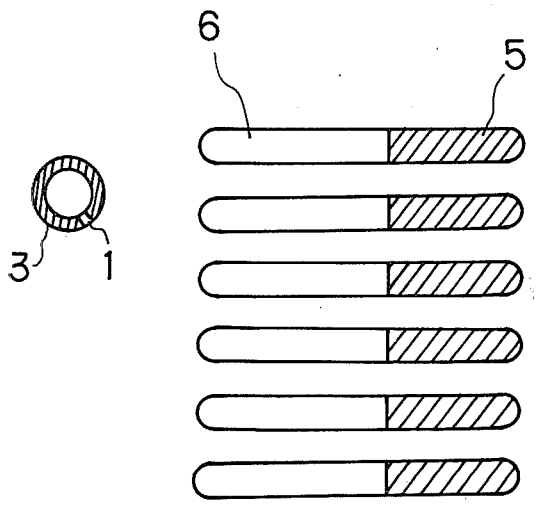
FIG. 4 is a section along the line IV—IV of FIG. 3.
Figure 5:
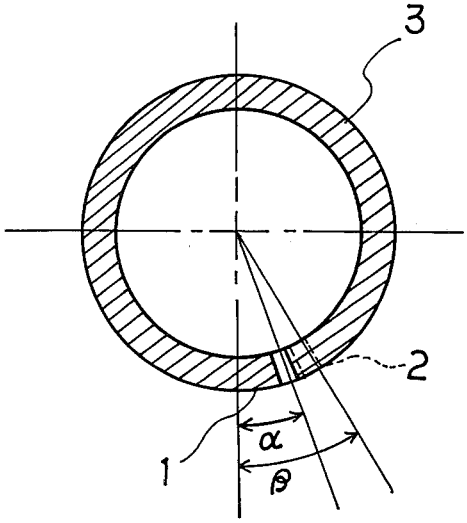
FIG. 5 is an enlarged sectional view of the auxiliary nozzle of FIG. 4.

Referring now to FIGS. 3 and 4, these illustrate a basic form of the auxiliary nozzle 3 of the present invention, according to which a first outlet opening 1 through which the fluid for assisting weft picking action is jetted and a second outlet opening 2 through which the fluid for stabilizing the movement of said weft are provided, respectively, in the tabular auxiliary nozzle 3 in such a manner that the fluid directing angles and fluid jetting velocities, the latter being determined by the diameter or size of dimensions of the outlet, of such outlets may be selected and established in the provision thereof, and also that such jetting outlet openings 1 and 2 are disposed apart from each other not only along the axis of the nozzle, as shown in FIG. 3, but also in terms of fluid directing angle, as shown in FIG. 5, so that interference of fluid issued from separate outlets thereby to cause harmful turbulence of fluid may be prevented from taking place. As shown in the drawings, the second outlet openings 2 are preferably larger than the first outlet openings 1, and are preferably narrow and elongated in shape in the direction of the length of the tubular nozzle 3. Similarly, the outlet opening 1 may have narrow, elongated shape as also shown in the drawings. In addition, it is apparent to those skilled in the art that both of the auxiliary nozzle outlet openings 1 and 2 arranged within the opening width of the weft picking channel formed by weft guide members 5.

Though depending upon various factors, such as weft picking velocity effected by the fluid jetted from the main nozzle 4, size of the weft 7 to be picked, etc., the angle "$\alpha$" formed between the axis of the jetting outlet opening 1 for assiting weft picking and the direction in which the weft 7 should be filled ranges from 15° to 25°, or preferably at 20° (FIG. 5); and another angle "$\beta$" made between the axis of the jetting outlet opening 2 for stabilizing weft position in picking and the weft picking direction is somewhere between 30° and 40°, or preferably at 35° (FIG. 5).

The diameter or size of dimensions of jetting outlet aperture, which governs and determine the jetting velocity of fluid passing therethrough, is made smaller in the outlet opening 1 than in the outlet opening 2 so that the fluid jetting velocity from the former outlet opening 1 can be set higher than that from the latter outlet opening 2. In addition, as described earlier herein, the outlet openings 1 and 2 are arranged in shifted relation along the axial direction of the nozzle 3 and also such that the axes of said outlets form an angle and are directed in different ways from each other, so that jetting flows of fluid from such two different sources may be prevented from acting against each other and thereby creating harmful disturbance of fluid streams.

Figure 6:
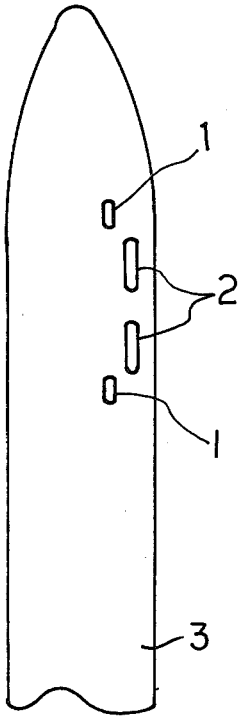
FIG. 6 is a side view of a modified auxiliary nozzle of the invention.
Figure 7:
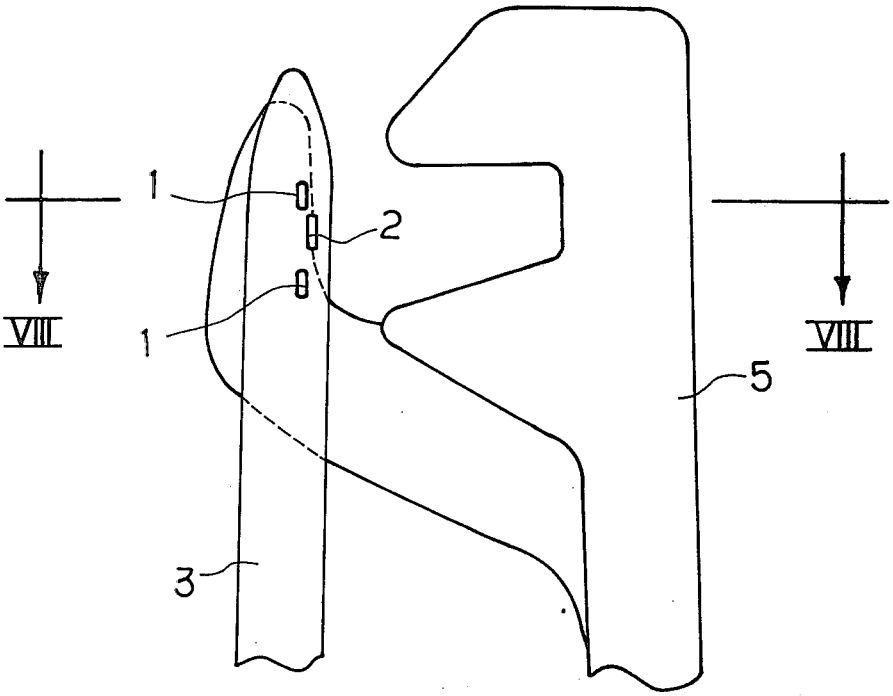
FIG. 7 is a side view of still another embodiment of the invention in which the auxiliary nozzle is provided in opposed relation to a semi-open type weft guiding member interposed between two adjacent weft guiding members having opening on the upper side thereof.
Figure 8:
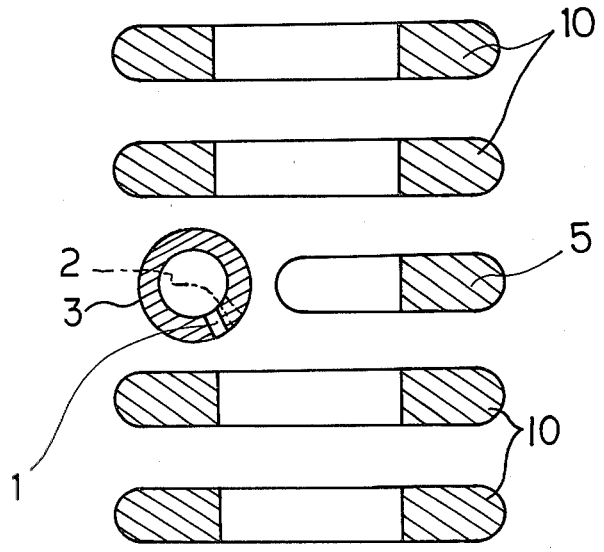
FIG. 8 is a transverse section of the arrangement as seen from line VIII—VIII of FIG. 7.
Figure 9:
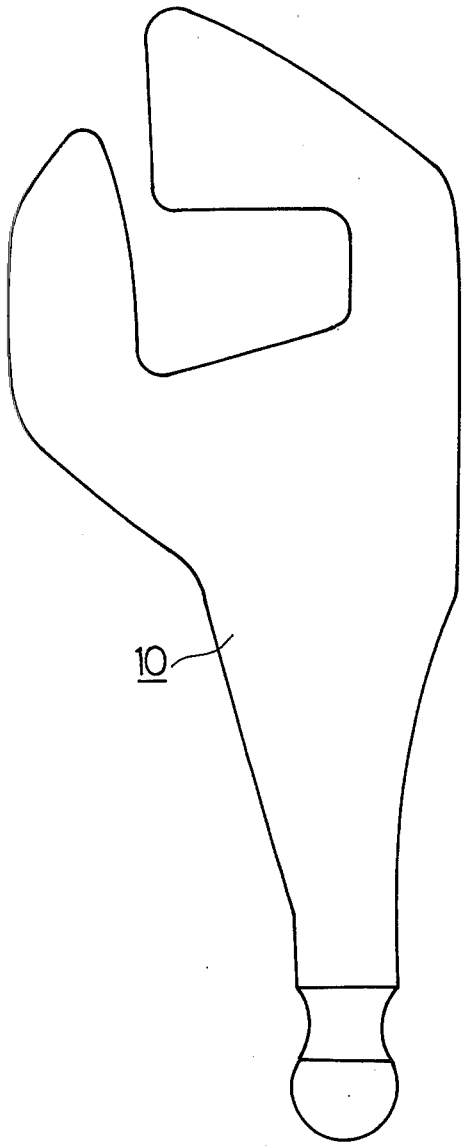
FIG. 9 PRIOR ART
FIG. 9 is an enlarged view showing an embodiment of a weft guiding member having an opening on the upper side thereof.

Referring to FIGS. 6 through 8, they present the other embodiments of the present invention, wherein the number of auxiliary nozzles's jetting outlet openings 1 and 2 and the manner of arrangement thereof are changed, and the form of weft guide members and the manner of arranging the auxiliary nozzles 3 are varied.

Referring specifically to FIG. 6, the auxiliary nozzle 3 is provided therein with jetting outlet openings 1, 1 for weft pick assisting and outlet openings 2, 2 for weft stabilizing, each consisting of two apertures, the latter pair of said jetting outlet openings 2, 2 being disposed between and within the former pair of said jetting outlet openings 1, 1 along the axial direction of the auxiliary nozzle 3, and the former and latter pairs of outlet openings 1, 1 and 2, 2 being arranged in such a way that the axes of the respective pairs form an angle, thus being adapted to direct fluid in different ways. In addition, the former outlet openings 1, 1 have smaller diameter or size of dimensions relative to the latter outlet openings 2, 2, as clearly shown in FIG. 6. By so arranging the jetting outlets, as compared with the above-mentioned embodiment represented by FIG. 3, the jets of fluid discharged from such outlet openings 1, 1 and 2, 2 can contribute further to realizing steady picking of the weft 7, as well as to prevention of fluid disturbance.

Referring now to FIGS. 7 and 8, still another embodiment is shown in which the auxiliary nozzle 3 is provided in opposite relation to a semi-open weft guiding member 5 interposed between two adjacent weft guiding members 10 having opening at the top thereof, and said auxiliary nozzle 3 having therein two jetting outlet openings 1, 1 with smaller aperture relative to a jetting outlet opening 2 provided in the same nozzle 3 between said outlet openings 1, 1 and forming an angle between the axis thereof and those of the outlet openings 1, 1. This manner of arrangement, since the auxiliary nozzle 3 according thereto is disposed in a position corresponding to the arm portion of the weft guiding members 10 arranged in a line and the jetting outlet openings 1, 1 and 2 of the auxiliary nozzle 3 face toward the weft picking channel, can make possible more effective utilization of jetting fluid, as well as provide compact arrangement thereof on the race 8.

The embodiments based on the concept of the present invention, as detailed in the above, can provide accurate and easy selection and setting of optimum jetting angle and velocity which contribute much to fulfillment of two functions (A) to assist the weft in being picked through the shed and (B) to stabilize the movement of such weft, and also minimize harful interference of fluid jets so that the weft picking operation may not be disturbed. This is accomplished by arranging the two kinds of jetting outlet openings 1 and 2 in shifted relation with respect to the axis of the auxiliary nozzle and in angled relation in reference to the axes of the outlet openings themselves.

In operation, the weft picked up into the shed by the jetting fluid discharged from the main nozzle of the loom can be further inserted through said shed completely and correctly with the aid of the weft pick assisting and stabilizing jets of fluid issued from separate, independant jetting outlet apetures formed in the auxiliary nozzle, thus performing complete and proper weft picking with a result that the quality of end product fabrics thus woven can be substantially improved.

It should be understood here that the number of jetting outlet openings 1 and 2 in the auxiliary nozzle 3 and the combination thereof for use are not intended to be limited to the exact embodiments of the invention and that various changes or modifications within the scope of the claims may be resorted to without departing from the spirit of the present invention. Thus, the form of weft guiding members is not intended, either, to be limited to the afore-mentioned embodiments and, therefore, guiding members formed, e.g., integral with the reed, so-called transformed reed, is possible to be used in combination with the apparatus of the invention.

What we claim is:

1. Improved auxiliary nozzles in a jet loom which comprises a fluid and weft guiding passage formed on a slay by guide members and extending in the filling direction and a plurality of said auxiliary nozzles provided in spaced relation to each other along said guiding passage and adapted to discharge jets of fluid through fluid outlet openings thereof; each of said auxiliary nozzles having therein a first outlet opening having a weft pick assisting function and a second outlet opening having a weft pick stabilizing function; and said outlet openings being positioned to discharge jets of fluid into said fluid and weft guiding passage with a distance between the axes thereof along the axial direction of said auxiliary nozzle and directed in such a way that the axes thereof will form an angle therebetween.

2. Improved auxiliary nozzles according to claim 1, wherein each of said first and second outlet openings in each said auxiliary nozzle is a single opening.

3. Improved auxiliary nozzles according to claim 1, wherein each of said first outlet openings is a single opening in each said auxiliary nozzle, and said second outlet openings comprise a plurality of openings in each said auxiliary nozzle.

4. Improved auxiliary nozzles according to claim 1, wherein said first outlet openings comprise a plurality of openings in each said auxiliary nozzle, and each of said second outlet openings is a single opening in each said auxiliary nozzle.

5. Improved auxiliary nozzles according to claim 1, wherein each of said first and second outlet openings in each said auxiliary nozzle comprises a plurality of openings, respectively.

6. Improved auxiliary nozzles according to claim 1, wherein an angle "$\alpha$" made between the axis of said first outlet opening and said filling direction ranges from substantially 15° to substantially 25°, and another angle "$\beta$" made between the axis of said second outlet opening and said filling direction ranges from substantially 30° to substantially 40°.

7. Improved auxiliary nozzles according to claim 6, wherein said angle "$\alpha$" is substantially 20°, and said angle "$\beta$" is substantially 35°.

8. Improved auxiliary nozzles according to claim 1, wherein those of said fluid and weft guide members which are in opposed relation to said auxiliary nozzles are each of a semi-opened type opening towards the auxiliary nozzle, and the remaining of said guide members each opens towards the top thereof.

9. Improved auxiliary nozzles according to claim 1, wherein all of said fluid and weft guide members are of a semi-opened type.

10. Improved auxiliary nozzles according to claim 1, wherein said guide members forming the fluid and weft guiding passage are formed integrally with a reed of the loom.

11. In a jet loom comprising an elongated fluid and weft guiding passage, the improvement comprising auxiliary fluid jet nozzle means positioned along the length of said fluid and weft guiding passage, said nozzle means providing a first fluid jet outlet opening for discharging fluid into said guiding passage in a direction to assist the movement of a weft thread therethrough, and a second fluid jet outlet opening for discharging fluid into said weft guiding passage in a direction to stabilize said weft thread passing therethrough, said direction of the first said jet outlet opening being at an angle with respect to the direction of said weft guiding passage, and said direction of the second jet outlet opening being at a larger angle with respect to said direction of the weft guiding passage.

12. A substantially tubular auxiliary nozzle for mounting adjacent to an elongated, jet loom fluid and weft guiding passage, said nozzle comprising a first fluid jet outlet opening at a location along the length of said nozzle for discharging fluid into said guiding passage in an angular direction with respect to the direction of said passage to assist the movement of a weft thread therethrough, and a second fluid jet outlet opening at a location along the length of said tubular nozzle which is arcuately spaced from said location of said first fluid jet outlet opening for discharging fluid into said guiding passage in an angular direction of said weft guiding passage to stabilize said weft thread passing therethrough.

13. A substantially tubular auxiliary nozzle according to claim 12 wherein said first and second fluid jet outlet openings are also spaced away from each other in the direction of the length of said nozzle.

14. A substantially tubular auxiliary nozzle according to claim 12 or claim 13 wherein the opening of said second fluid jet outlet opening is larger than that of said first fluid jet outlet opening.

15. A substantially tubular auxiliary jet nozzle according to claim 14 wherein at least said second fluid jet outlet opening is elongated in the direction of the length of said nozzle.

16. A substantially tubular auxiliary jet nozzle according to claim 15 wherein each of said first and second fluid jet outlet openings is elongated in the direction of the length of said nozzle.

* * * * *